US009097109B2

(12) United States Patent
Boekholtz et al.

(10) Patent No.: US 9,097,109 B2
(45) Date of Patent: Aug. 4, 2015

(54) INJECTION DRILL BIT

(75) Inventors: Edo Boekholtz, Copenhagen K (DK); Ulger Gokhan, Gelsenkirchen (DE); Klaus Wahrmann, Gelsenkirchen (DE)

(73) Assignee: MAERSK OLIE OG GAS A/S, Copenhagen K (DK)

( * ) Notice: Subject to any disclaimer, the term of this patent is extended or adjusted under 35 U.S.C. 154(b) by 332 days.

(21) Appl. No.: 13/509,517

(22) PCT Filed: Nov. 9, 2010

(86) PCT No.: PCT/EP2010/067129

§ 371 (c)(1), (2), (4) Date: Jul. 30, 2012

(87) PCT Pub. No.: WO2011/058014

PCT Pub. Date: May 19, 2011

(65) Prior Publication Data

US 2012/0279710 A1 Nov. 8, 2012

Related U.S. Application Data

(60) Provisional application No. 61/261,045, filed on Nov. 13, 2009.

(30) Foreign Application Priority Data

Nov. 13, 2009 (DK) ..... 2009 70204

(51) Int. Cl.
*E21B 43/112* (2006.01)
*E21B 7/04* (2006.01)

(52) U.S. Cl.
CPC ..... *E21B 43/112* (2013.01); *E21B 7/046* (2013.01)

(58) Field of Classification Search
CPC ..... E21B 29/00; E21B 29/06; E21B 10/02; E21B 49/06; E21B 7/061; E21B 43/112
USPC ..... 166/297, 298; 175/77, 78, 79
See application file for complete search history.

(56) References Cited

U.S. PATENT DOCUMENTS 2,381,929 A * 8/1945 Schlumberger ..... 166/55.1
2,516,421 A 7/1950 Robertson (Continued)

FOREIGN PATENT DOCUMENTS

EP 0791723 A1 8/1997
GB 2 433 760 A 7/2007

OTHER PUBLICATIONS

Search Report for Application No. PA 2009 70204 dated Jun. 18, 2010.

(Continued)

*Primary Examiner* — Robert E Fuller
(74) *Attorney, Agent, or Firm* — Brinks Gilson & Lione

(57) ABSTRACT

A device for drilling a hole in a well tubular and for subsequent injection of a fluid or fluid mixture into an annular space or formation surrounding the well tubular. The device comprises a housing and a drill bit assembly arranged inside the housing. In the drill bit assembly, a drill bit with cutting edges and grooves extending along its outside surface, is arranged. The device further comprises rotation means being capable of rotating the drill bit assembly and a fluid supply for supplying a fluid or fluid mixture to the grooves of the rotating drill bit. A seal is surrounding the drill bit and capable of sealing the device against the inner surface of the well tubular.

19 Claims, 6 Drawing Sheets

(56) References Cited

U.S. PATENT DOCUMENTS

| | | | | |
|---|---|---|---|---|
| 2,725,283 | A * | 11/1955 | Mounce et al. | 422/50 |
| 3,301,337 | A * | 1/1967 | Vaughn et al. | 175/22 |
| 4,368,786 | A | 1/1983 | Cousins | |
| 5,183,111 | A * | 2/1993 | Schellstede | 166/298 |
| 6,523,624 | B1 | 2/2003 | Cousins et al. | |
| 6,772,839 | B1 | 8/2004 | Bond | |
| 7,905,286 | B2 * | 3/2011 | Moody et al. | 166/298 |
| 2002/0023781 | A1 * | 2/2002 | Peters | 175/67 |
| 2006/0081398 | A1 * | 4/2006 | Arian et al. | 175/58 |
| 2008/0115940 | A1 | 5/2008 | Brunet et al. | |
| 2012/0193152 | A1 * | 8/2012 | Russell et al. | 175/430 |

OTHER PUBLICATIONS

International-Type Search Report for Application No. DK 200970204 dated Jun. 30, 2010.

* cited by examiner 20-20

20-20

INJECTION DRILL BIT

FIELD OF THE INVENTION

The invention relates to a device for drilling a hole in a well tubular and for subsequent injection of a fluid or fluid mixture into an annular space or formation surrounding the well tubular, the device comprises a housing; a drill bit assembly arranged inside said housing, the drill bit assembly comprising a drill bit having a cutting edge or cutting edges and grooves extending along its outside surface; and rotation means connected to said drill bit assembly, the rotation means being capable of rotating the drill bit assembly.

BACKGROUND OF THE INVENTION

When constructing a well for oil and gas production a well tubular is introduced into a drilled well. To optimize production it is sometimes necessary to perform operations affecting an annular space surrounding the well tubular by e.g. injecting substances.

A common way to do this is to create a perforation in the well tubular and subsequently injecting a substance. The task of creating a perforation and injecting a substance is however not trivial. It often requires multiple time consuming operations to be carried out inside the well. First the well has to be sealed below the perforation area. Secondly a device for creating the perforation is deployed. Thirdly a device for injecting a substance through the perforation is lowered into the well and fourthly the established seal has to be removed for the well to be operable.

U.S. Pat. No. 6,915,853 discloses a device for drilling horizontal holes in an oil well. The device comprises holding means for positioning the device in the well and drilling means radially extendable for perforating the well casing.

When the device is positioned in the well the drilling means can be radially extended by activating a lever initiating the drilling operation.

U.S. Pat. No. 6,772,839 discloses a device for piercing a well tubular and injecting a substance through the piercing member into an annular space. The device comprises a tool body suitable for being arranged in a well tubular, a perforating assembly and a setting-off assembly for positioning the device in a well tubular. The device further comprises a fluid connection to the surface of the well for supplying a substance to be injected through the device.

Time is a crucial factor when performing operations inside an oil well. The state of the art shows numerous examples of how to drill holes in a well tubular and injecting a substance. This is however carried out in separate operations each requiring lots of equipment and execution time.

SUMMARY OF THE INVENTION

Disclosed herein is a device for drilling a hole in a well tubular and for subsequent injection of a fluid or fluid mixture into an annular space or formation surrounding the well tubular. This is achieved by the device comprising a fluid supply for supplying a fluid or fluid mixture to the grooves of the rotating drill bit; a drill seal surrounding the drill bit, for sealing the device against the well tubular; drive means for advancing the drill bit assembly towards the well tubular.

Disclosed herein is further how the device can be used for performing operations inside a well tubular and for injecting a fluid or fluid mixture through a perforation in the surface of a well tubular.

Disclosed is also a drill bit having cutting edges and grooves extending along its outside surface and further having a peripheral mounted drill seal.

An advantage in this respect is the combined use of grooves for both drilling and injecting a fluid or fluid mixture. By using a seal in combination with a drill bit the grooves can be used for injection purposes. This is a way of reducing the number of operations and time necessary for injecting a substance into an annular space surrounding a well tubular.

In one embodiment of the invention a device is provided where the grooves extending along the outside surface of the drill bit are helical grooves.

In another embodiment of the invention a device is provided wherein the fluid supply for supplying a fluid or fluid mixture to the grooves are fluidly connected to a container inside the housing and the container is suitable for containing a fluid or fluid mixture.

In still another embodiment of the invention a device is provided, wherein the fluid supply for supplying a fluid or fluid mixture to the grooves is connected to the end of the drill bit opposite the cutting edge, such that fluids can be transported from the device and into an annular space via the grooves, while the drill bit extends through the well tubular.

Other embodiments of the invention are recited in the dependent claims 2, 4 and 6-16.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

FIG. 1*a* shows the drill bit assembly in an intermediate position where the drill bit has penetrated the well tubular.

FIG. 1*b* shows the drill bit assembly in an intermediate position where the drill seal is touching the inner surface of the well tubular.

FIG. 1*c* shows the drill bit assembly in the most extended position where the drill seal is pressed against the inner surface of the well tubular.

Figure 1A:
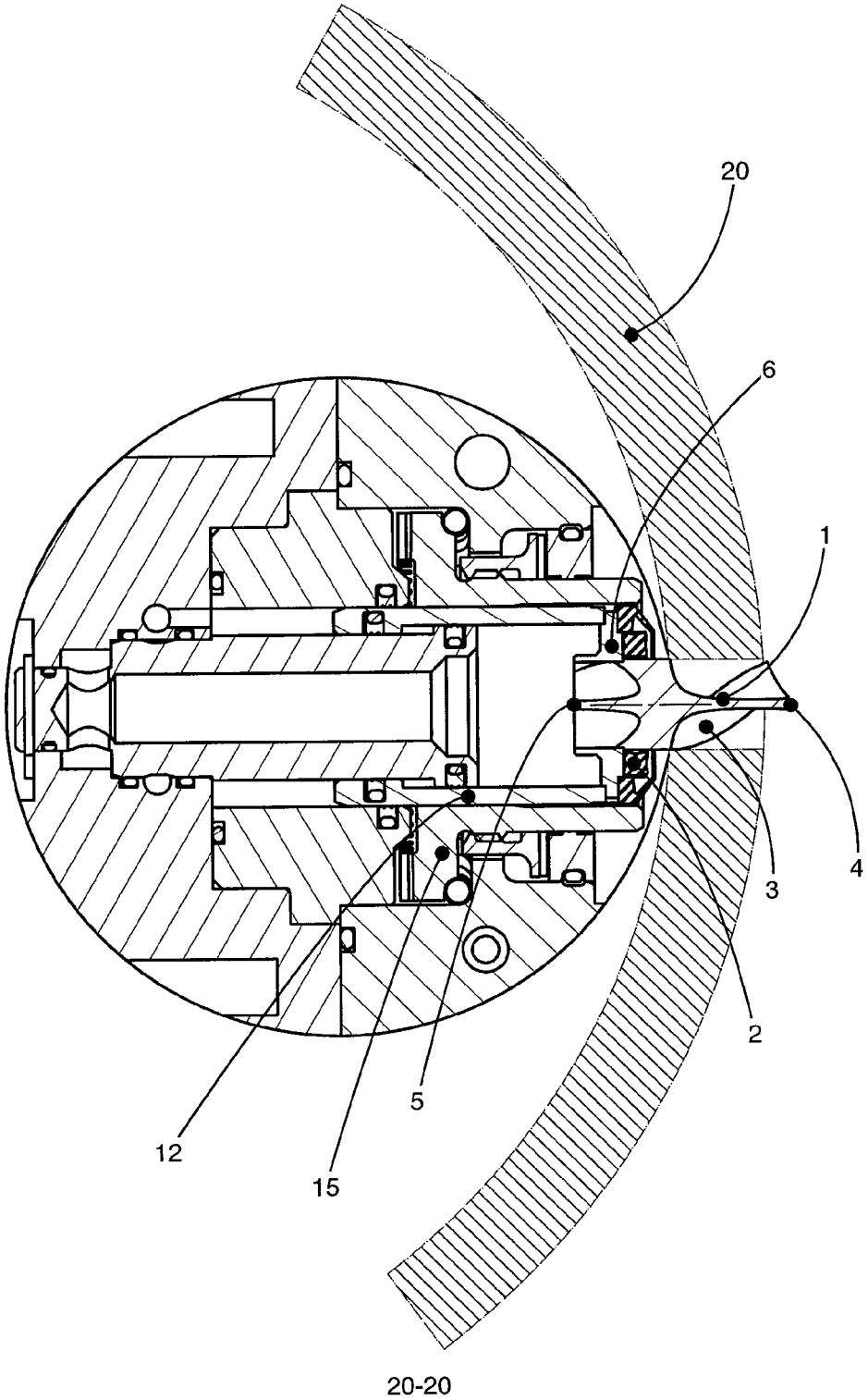
FIG. 1*a-c* is a cross section A-A of the device shown in FIG. 3.
Figure 1B:
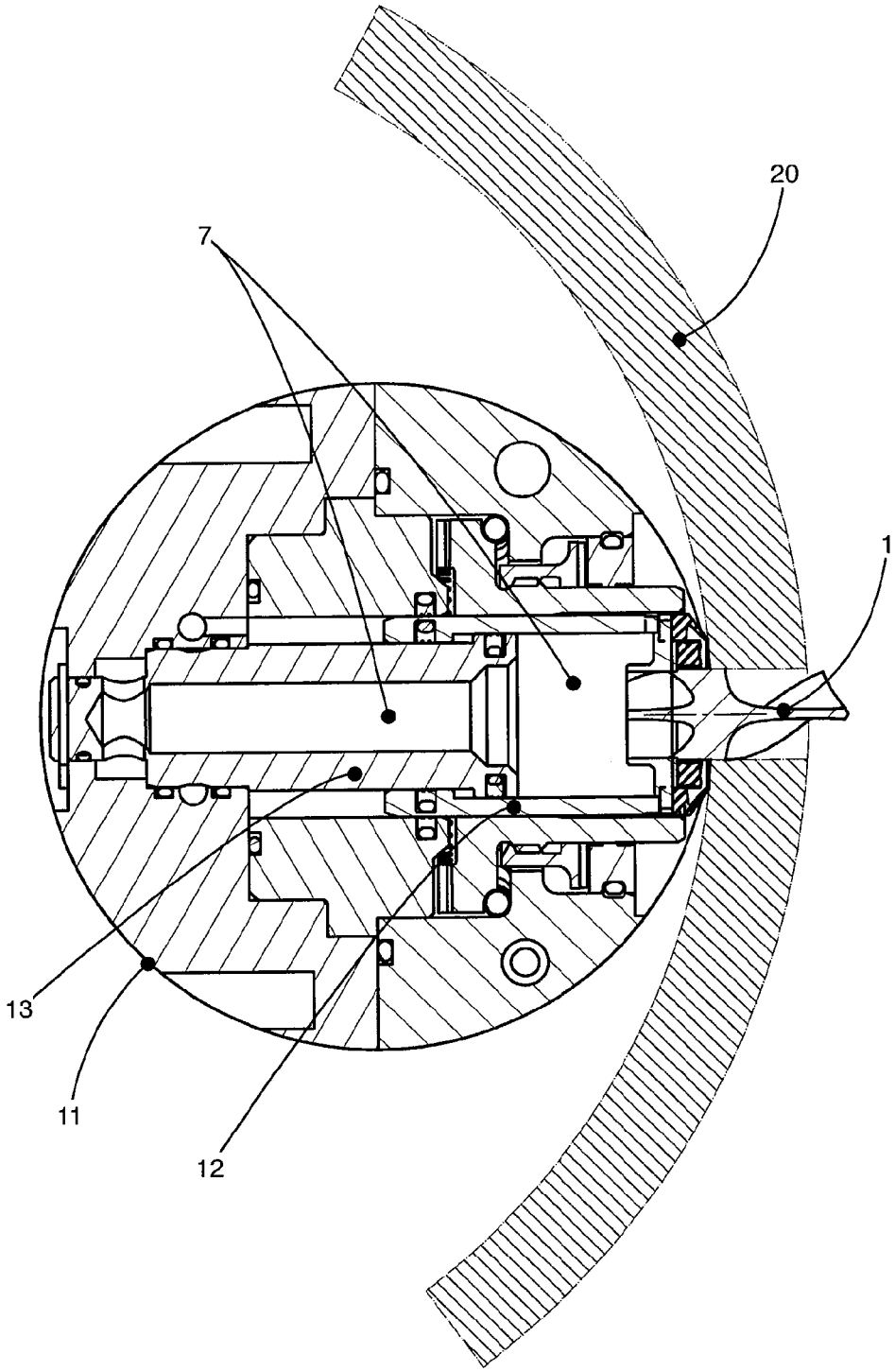

It should be emphasized that the term "comprises/comprising/comprised of" when used in this specification is taken to specify the presence of stated features, integers, steps or components but does not preclude the presence or addition of one or more other features, integers, steps, components or groups thereof.

DETAILED DESCRIPTION OF THE EMBODIMENTS

With reference to the drawings there is shown one embodiment of a device (50) having a housing (11), a drill bit assembly and rotation means (14). The drill bit assembly is arranged in the housing (11) and connected to the rotation means (14).

The drill bit assembly comprises a drill sleeve (12) in the form of a tubular element with a top plate (6), a drill bit (1) and a drill seal (2). The drill bit (1) and the drill seal (2) are mounted to the top plate (6). The drill seal (2) is arranged around the drill bit (1) at the base of the drill bit (1). The base of the drill bit (1) should be understood as the position where the drill bit (1) intersects the top plate (6). The drill bit (1) has a conical shaped front end (4) and a back end (5) penetrating the top plate (6). Helical grooves (3) are extending along the outside surface of the drill bit (1) from the front end (4) to the back end (5). Further the drill bit (1) has cutting edges at the front end (4) and along the helical grooves (3). The drill bit (1) could be interpreted as a twist drill.

The rotating means (14) are connected to the drill sleeve (12) of the drill bit assembly by means of a gear (15) e.g. a spur wheel/gear. When activated, the rotation means (14) rotate the drill sleeve (12) causing the drill bit (1) and drill seal (2) to rotate. The rotation means could e.g. be an electro motor, hydraulics or other means known to a person skilled in the art.

The drill bit (1) is mounted on the top plate (6) in such a manner, that the grooves (3) extending all the way to the back end (5) of the drill bit (1) is accessible from the back end (5). Depending on the stage of operation the grooves (3) are either drilling grooves for removing drilling residue or injection grooves for injecting a fluid or fluid mixture.

Figure 1C:
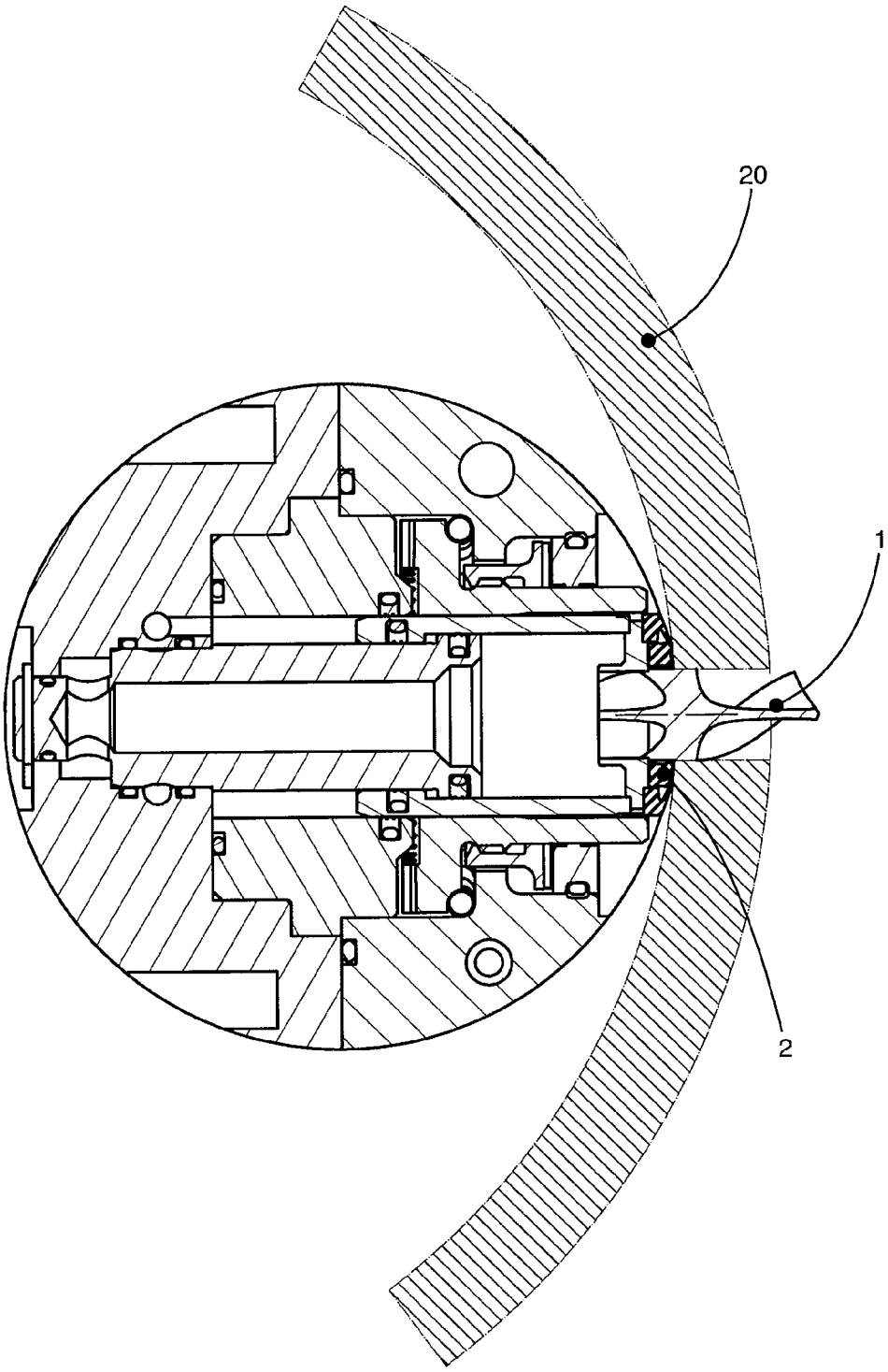
Figure 3:
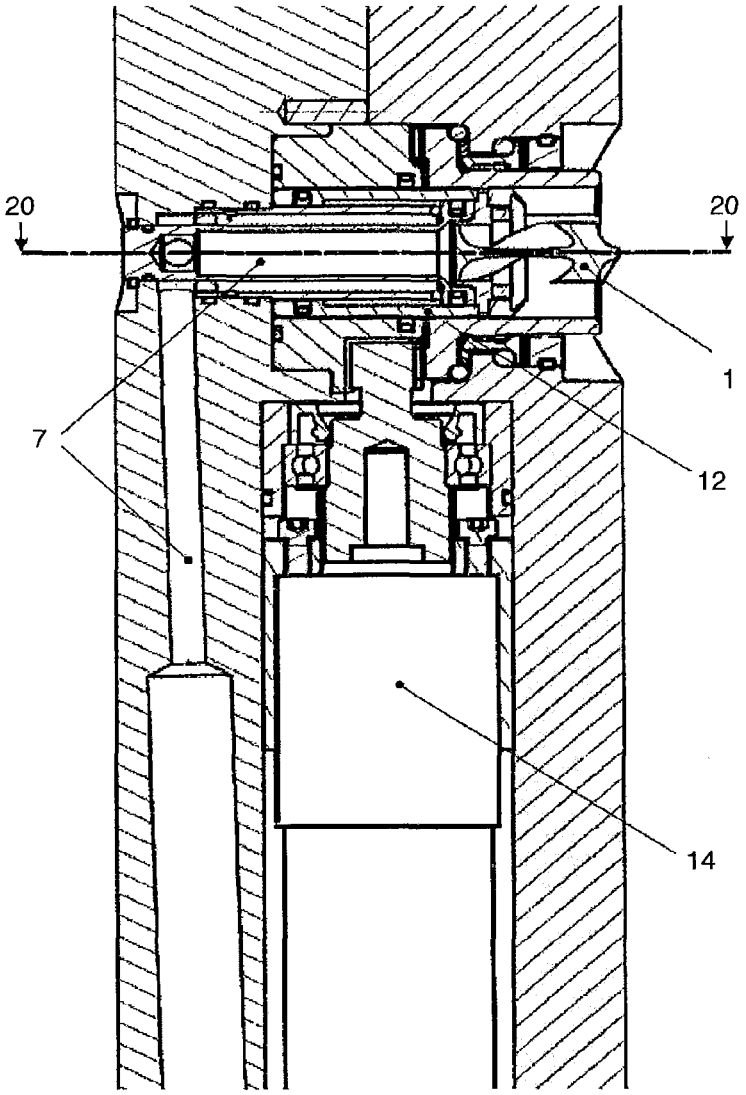
FIG. 3 is a cross sectional view of a part of the device in a longitudinal direction.

The drill bit assembly can be radially advanced from a retracted position inside the housing (11) as shown in FIG. 3 to an extended position as shown in FIG. 1C. When necessary the drill bit assembly can be retracted to a position inside the housing (11). The radial movement of the drill bit assembly can be obtained by various drive means e.g. hydraulic pressure, mechanically or other means known to a person skilled in the art. In one embodiment the drill bit assembly is moved by supplying hydraulic pressure to the drill sleeve (12). By applying pressure to and advancing the drill bit assembly drilling operations can be carried out. During drilling operations drilling residue can escape from the drill bit (1) through the drilling grooves (3).

The size of the drilling residue is among others determined by a combination of the drill bit design, the amount of pressure supplied on the drill bit (1) and the revolution speed. To achieve a satisfactory drilling result the drill bit (1) has special machined cutting edges and a special cutting angle.

When the drill bit (1) has drilled all the way through the well tubular (20) a fluid tight seal is created by advancing the drill bit assembly further, there by pressing the drill seal (2) against the well tubular (20).

Figure 2:
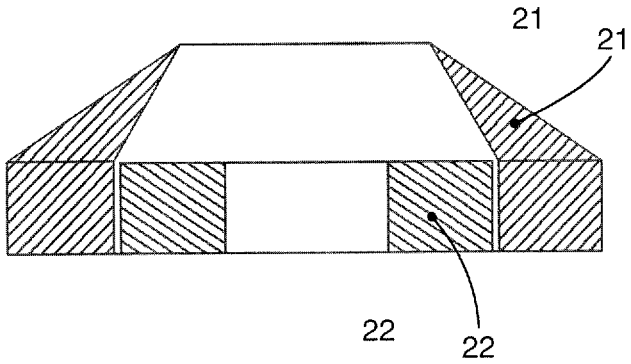
FIG. 2 is a schematic drawing of one embodiment of the drill seal.

Referring to FIG. 2 there is shown a schematic drawing of one embodiment of the drill seal (2) comprising an outer ring (21) e.g. a lip seal and an inner ring (22) e.g. an x-seal. When the drill seal (2) is pressed against the inner surface of the well tubular (20) and fluid pressure builds up inside the outer ring (21) a fluid tight seal is created between the drill seal (2) and the inner surface of the well tubular (20). The drill seal (2) has a self-reinforcing effect, in that the pressure of the fluid will amplify the sealing mechanism. The pressure exerted on the inner faces of the drill seal (2) will amplify the sealing effect. The established seal creates a fluid connection extending from the back end (5) of the drill bit (1), through the injection grooves (3) and into an annular space or even under special circumstances into a formation surrounding the well.

With the drill bit assembly in its most extended position and the drill seal (2) pushed against the well tubular (20) injection operations can be carried out. By supplying a fluid or fluid mixture via a fluid supply to the back end (5) of the drill bit (1), a fluid or fluid mixture can be injected through the injection grooves (3) into an annulus of the well or into a formation. The fluid or fluid mixture such as amongst others epoxy is supplied from one or more containers inside the housing (11), through the feed channel (7) to the injection grooves (3). In one embodiment the device has different containers containing different fluids or fluid mixtures. Inside the feed channel (7), means for mixing (not shown) the supplied fluids are arranged. This could e.g. be a static mixer that by affecting the flow path causes the fluids to be mixed.

Pressure from the injected fluid or fluid mixture will remove drilling residue that could have built up in the grooves during drilling operations. In case the injection grooves are clogged during injection the drill bit can be rotated to remove blocking material.

The part of the feed channel (7) connected to the back end (5) of the drill bit (1) is extended as the drill bit (1) moves in a radial direction. This is accomplished by the drill sleeve (12) moving relatively to the feed channel sleeve (13). As the drill bit (1) moves toward the extended position the overlap between the drill sleeve (12) and the feed channel sleeve (13) is gradually reduced, increasing the total length of the feed channel.

To control the position of the drill bit (1) a sensor system is incorporated in the device (50). The sensor system is used to avoid damaging the drill seal (2) by simultaneously rotating and pressing it against the inner surface of the well tubular (20). When the drill bit (1) has penetrated the well tubular (20), the rotation of the drill bit assembly is stopped at a predetermined position. The drill bit assembly is then advanced and the drill seal (20) is pressed against the inner surface of the well tubular (20) to engage in a fluid tight seal with the well tubular (20).

In one embodiment the sensor system is a magnetic sensor system comprising a magnet (not shown) rigidly connected to the drill sleeve (12) and a sensor (not shown) arranged inside the housing (11) for detecting the exact position of the drill bit (1) in a radial direction. It would however be obvious to a person skilled in the art, that the above described sensor system could be created in many different ways.

USE OF THE INVENTION

After the description of the device, its use and operation is specified in further detail.

Figure 4:
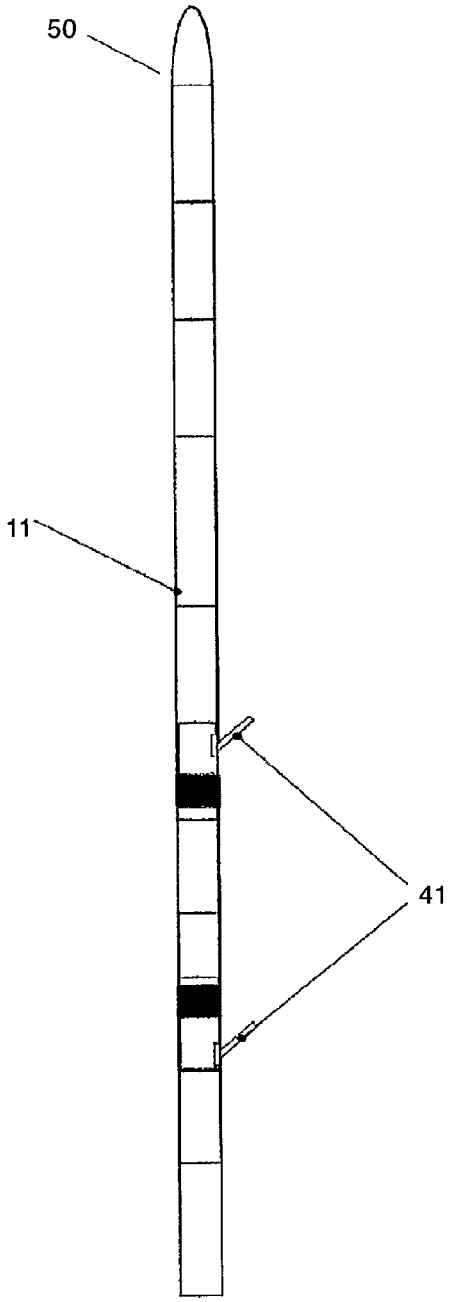
FIG. 4 shows a schematic drawing of one embodiment of the device, with jacking arms in an extended position.

The device suitable for operating inside a well is inserted into a well tubular by conventional means such as a coiled tubing, drill string or the like known to a person skilled in the art, and will therefore not be described in any further detail. Once the device is at the position under consideration the jacking arms (41) are extended from the housing (11), see e.g. FIG. 4. The purpose of the jacking arms (41) is to fixate the device inside the well tubular during drilling and injection operations. When the device is pressed against the inner surface of the well tubular drilling operations can be commenced by moving the drill bit assembly in a radial direction towards the inner surface of the well tubular (20). By rotating and gradually advancing the drill bit, the cutting edge of the drill bit is capable of drilling through the well tubular (20). When the drill bit has cut all the way through the well tubular (20), the drill seal (2) is pressed against the inner surface of the well tubular (20) by further advancing the drill bit assembly. The fluid tight flow passage created through the injection channels (3) of the drill bit (1) can thus be used for injecting a fluid or fluid mixture into an annular space. In case a fluid or fluid mixture such as epoxy is supplied under pressure to the back end (5) of the drill bit (1), the fluid or fluid mixture will flow through the injection grooves (3) and into an annular space surrounding the well.

After the fluid or fluid mixture has been injected the drill bit (1) is retracted to a position inside the housing (11) as shown in FIG. 3. The jacking arms (41) are retracted and the device is no longer fixated inside the well tubular. The device can then be moved to perform operations is a different position or pulled out of the well and prepared for subsequent redeployment.

The use of the above described drilling device is not limited to well tubulars. The drilling device could also be used in other tubular structures such as but not limited to piping systems, sewage pipes, water pipes, waste pipes, downpipes, ventilation shafts, chimneys, wind turbine towers, tunnels or narrow shafts.

It is to be noted that the figures and the above description have shown the example embodiments in a simple and schematic manner. The internal electronics and mechanical details have not been shown since a person skilled in the art should be familiar with these details and they would just unnecessarily complicate this description.

The invention claimed is:

1. A device for drilling a hole in a well tubular and for subsequent injection of a fluid or fluid mixture into an annular space or formation surrounding said well tubular comprising:

(a) a housing;

(b) a drill bit assembly arranged inside said housing, said drill bit assembly comprising:

a drill bit having one or more cutting edges and grooves, said one or more cutting edges and said grooves extending along the outside surface of said drill bit;

(c) rotation means connected to said drill bit assembly, said rotation means being capable of rotating said drill bit assembly;

(d) a fluid supply for supplying a fluid or fluid mixture to said grooves of said rotating drill bit;

(e) a drill seal surrounding said drill bit, for forming a seal against said well tubular;

(f) drive means for advancing said drill bit assembly together with said drill seal from said housing towards said well tubular in order to press the drill seal against the well tubular.

2. The device according to claim 1, wherein said grooves extending along the outside surface of said drill bit are helical grooves.

3. The device according to claim 1, wherein said fluid supply for supplying a fluid or fluid mixture to said grooves is fluidly connected to at least one container inside said housing, said container being suitable for containing a fluid or fluid mixture.

4. The device according to claim 1, wherein said fluid supply for supplying a fluid or fluid mixture to said grooves is connected to the end of said drill bit opposite said cutting edge, such that fluid can be transported from the device and into an annular space via said grooves, when said drill bit extends through the well tubular and the drill seal is pressed against the well tubular.

5. The device according to claim 1, wherein said drive means is configured to retract said drill bit assembly.

6. The device according claim 1, wherein the pressure of the injected fluid will amplify the sealing effect of said drill seal on injection of said fluid or fluid mixture.

7. The device according to claim 6, wherein a portion of said drill seal remains within said housing when said drill bit and said drill seal are advanced.

8. The device according to claim 1, wherein said drill seal has converging inner faces.

9. The device according to claim 1, comprising a sensor for determining the position of the drill bit in a radial direction.

10. The device according to claim 9, wherein said sensor is a magnetic sensor that detects the position of a magnet rigidly mounted to a drill sleeve.

11. The device according to claim 1, wherein said drill bit assembly comprises a rotatable drill sleeve connected to said drill bit and to said drive means.

12. The device according to claim 11, wherein said drill sleeve is connected to said rotation means.

13. The device according to claim 12, wherein said drill seal is mounted on said drill sleeve.

14. The device according to claim 1, comprising means for pressing said device against the inner surface of said well tubular.

15. A method for performing an operation in a well tubular comprising:

lowering a device according to claim 1 into the well tubular;

drilling a hole in the well tubular using the device; and injecting a fluid into an annular space or formation surrounding the well tubular.

16. A method for performing an operation in a well tubular comprising:

lowering a device according to claim 14 into the well tubular;

drilling a hole in the well tubular using the device; and injecting a fluid or fluid mixture through the drilled hole in the well tubular.

17. A method of injecting a fluid into a formation, using the device according to claim 1, wherein a hole is drilled in a well tubular using said drill bit and wherein said fluid is injected while said drill bit extends through said well tubular and the drill seal is pressed against the well tubular.

18. A device for drilling a hole in a well tubular and for subsequent injection of a fluid or fluid mixture into an annular space or formation surrounding said well tubular comprising:

(a) a housing;

(b) a drill bit assembly arranged inside said housing, said drill bit assembly comprising:

a drill bit having one or more cutting edges and grooves, said one or more cutting edges and said grooves extending along the outside surface of said drill bit;

(c) rotation means connected to said drill bit assembly, said rotation means being capable of rotating said drill bit assembly;

(d) a fluid supply for supplying a fluid or fluid mixture to said grooves of said rotating drill bit;

(e) a drill seal surrounding said drill bit, for sealing said device against said well tubular;

(f) drive means for advancing said drill bit assembly together with said drill seal towards said well tubular in order to press the drill seal against the well tubular, wherein the pressure of the injected fluid will amplify the sealing effect of said drill seal on injection of said fluid or fluid mixture.

19. A device for drilling a hole in a well tubular and for subsequent injection of a fluid or fluid mixture into an annular space or formation surrounding said well tubular, comprising:

(a) a housing;

(b) a drill bit assembly arranged inside said housing, said drill bit assembly comprising:

a drill bit having one or more cutting edges and grooves, said one or more cutting edges and said grooves extending along the outside surface of said drill bit;

(c) rotation means connected to said drill bit assembly, said rotation means being capable of rotating said drill bit assembly;

(d) a fluid supply for supplying a fluid or fluid mixture to said grooves of said rotating drill bit;

(e) a drill seal surrounding said drill bit, for sealing said device against said well tubular;

(f) drive means for advancing said drill bit assembly together with said drill seal towards said well tubular in order to press the drill seal against the well tubular, wherein said drill bit assembly comprises a rotatable drill sleeve connected to said drill bit and to said drive means.

* * * * *